US006334710B1

(12) United States Patent
Kuge et al.

(10) Patent No.: US 6,334,710 B1
(45) Date of Patent: Jan. 1, 2002

(54) SELF-STANDING CONTAINER

(75) Inventors: Raizo Kuge; Yoshiji Moteki, both of Tokyo-to (JP)

(73) Assignee: Hosokawa Yoko Co., Ltd. (JP)

( * ) Notice: Subject to any disclaimer, the term of this patent is extended or adjusted under 35 U.S.C. 154(b) by 0 days.

(21) Appl. No.: 09/469,629

(22) Filed: Dec. 22, 1999

(51) Int. Cl.[7] ..... B65D 30/16
(52) U.S. Cl. ..... 383/104; 383/116; 383/119
(58) Field of Search ..... 383/104, 119, 383/120, 63, 116

(56) References Cited

U.S. PATENT DOCUMENTS 5,165,568 A * 11/1992 Wischusen, III ..... 383/119 X
5,364,189 A * 11/1994 Kuge et al. ..... 383/63 X
5,762,260 A * 6/1998 Goglio ..... 383/119 X
5,842,790 A * 12/1998 Imer ..... 383/119 X

FOREIGN PATENT DOCUMENTS

| | | | | |
|---|---|---|---|---|
| DK | 0082523 | * | 3/1957 | ..... 383/119 |
| FR | 2559128 | * | 8/1985 | ..... 383/119 |
| GB | 0627711 | * | 8/1949 | ..... 383/119 |
| JP | 405221451 A | * | 8/1993 | ..... 383/104 |

* cited by examiner

*Primary Examiner*—Jes F. Pascua
(74) *Attorney, Agent, or Firm*—Parkhurst & Wendel, L.L.P.

(57) ABSTRACT

A self-standing container comprises a tubular main body and a bottom-forming sheet. The main body has upper and lower end portions, which are opened. The bottom-forming sheet is joined to the periphery of the lower end portion by a fusion-bonding so as to form a self-standing container having a flat bottom. Each of the main body and the bottom-forming sheet comprises a laminate film having at least two layers. Each of the at least two layers has a thickness of from 20 $\mu$m to 120 $\mu$m.

10 Claims, 14 Drawing Sheets

SELF-STANDING CONTAINER

BACKGROUND OF THE INVENTION

1. Field of the Invention

The present invention relates to a self-standing container, which is suitably used as a container for receiving solid, powdery or granular material or the like.

2. Description of the Related Art

With respect to containers for receiving various products of solid, powdery or granular material, there are demands for characteristic properties of self-standing, maintaining the product's form, wrapping easily the product, seeing through the product received in the container and the like, which properties depend on the kind of the product.

With respect to the container in which a small amount of contents such as coffee, cocoa, sugar, salt, seasoning, powdery milk, cleanser or the like that is received in the container, is to be used at a time, the self-standing property is demanded with the result that there is used a container having rigidity such as a paper box and a wide-mouthed bottle. There is a case where a lined carton in which inside and outside layers are formed integrally with each other is used for a business use. When the transparency of the container is demanded, a glass bottle or a transparent plastic container is used.

With respect to the container for receiving the products in a stacking state, i.e., confectionery such as cookie, laver, tea bags, medicine packets, and the like, the characteristic properties of maintaining the product's form, wrapping easily the product and seeing through the product received in the container with the result that there is used a container having rigidity such as a paper box, plastic containers having rigidity and transparency, or a container that can be obtained by covering a tray-shaped member having rigidity, for example, a plastic member formed by a vacuum forming, with a transparent film.

With respect to the container for receiving retort pouch food to be heated by means of a microwave oven, there is used a container that can be obtained by covering the above-mentioned tray-shaped member having rigidity, which can also be used as a tray, with an outer layer so as to be capable of being subjected to a heating process with the use of the microwave oven.

However, the containers having rigidity or provided with the tray are so relatively bulky to cause inconvenient problems of transportation and handling of the empty containers. In addition, it is difficult to decrease the weight of the container and meet the demands for reduced cost and waste disposability. There have conventionally been used a pouch package formed of a laminate film in order to meet the above-mentioned demands. It is however difficult to form a self-standing container with the use of the pouch package, since the laminate film thereof does not have sufficient rigidity. More specifically, the pouch package is not suitable for the container for receiving products of solid, powdery or granular material.

Japanese Patent Application Nos. H6-114,803 and H8-25,603 and Japanese Utility Model Application No. H4-40,497 were filed in the name of the applicant to propose a method for manufacturing a self-standing bag.

SUMMARY OF THE INVENTION

An object of the present invention is therefore to provide a self-standing container, which has the ensured self-standing property even in case that the thickness of the self-standing bag manufactured in accordance with the inventions of the above-mentioned Japanese applications is decreased, and has an easy waste disposability and an excellent handling and convenience property as well as an excellent property of maintaining the form of products such as solid, powdery or granular material.

In order to attain the aforementioned object, the self-standing container of the present invention comprises:

a main body having a tubular shape, said main body having an upper end portion and a lower end portion, which are opened; and a bottom-forming sheet, which is joined to a periphery of said lower end portion by a fusion bonding so as to form a self-standing container having a flat bottom, wherein:

each of said main body and said bottom-forming sheet comprises a laminate film having at least two layers, each of said at least two layers having a thickness of from 20 $\mu$m to 120 $\mu$m.

According to the present invention having the above-described features, the flat bottom can provide the self-standing property of the container, even when the laminate film as used has a relatively small thickness of from 20 $\mu$m to 120 $\mu$m, thus improving the handling and convenience property. The small thickness of the laminate film makes it possible to decrease the weight of the container and provide an excellent waste disposability. When the container receives fragile contents such as laver, rice cake, flowers, toys or the like, it is possible to fill the container with nitrogen gas or air to provide a cushioning effect so as to protect the contents.

The above-mentioned self-standing container may have a sealing member provided in the upper end portion of the main body. The sealing member can keep the container in a sealed condition again after a part of the contents is pulled out of the container, thus providing the advantageous effects when a small amount of the contents is used at a time. The container can be kept in a sealed condition after filling it with gas such as air so as to maintain the original shape of the container that has not as yet been opened. As a result, the container can be stored in a prescribed size. The above-mentioned sealing member preferably comprises a fastener by which the container can be opened or closed.

The self-standing container of the present invention may have a holder formed of paper, which is inserted in the container. The holder made of paper can maintain a prescribed shape of products such as medicine packets of granular digestive or cold medicine, packets for brew beverage such as tea, green tea or the like, and tea bags. In addition, the holder can arrange the contents in a proper condition so that an amount of the contents can easily be recognized, thus providing a convenient effect. The formation of the holder of paper can provide an easy waste disposing treatment and impart the folding property to the holder, leading to an easy handling. The holder preferably has a trough-shape with a U-shaped cross section.

The self-standing container of the present invention preferably has a structure that the laminate film comprises an outer layer and an inner layer; the outer layer comprises any one of an oriented polypropylene (OPP) layer having a thickness of from 15 $\mu$m to 60 $\mu$m, a polyethylene terephthalate (PET) layer having a thickness of from 9 $\mu$m to 25 $\mu$m and a vacuum metalization oriented polypropylene (VMOPP) layer having a thickness of from 9 $\mu$m to 50 $\mu$m; and the inner layer comprises a non-oriented polypropylene (CPP) layer having a thickness of from 15 $\mu$m to 80 $\mu$m. In such a structure, the laminate film may comprise the appropriate layers having their individual properties, depending on the kind of the contents or the handling method thereof.

When there is adopted a structure that the laminate film comprises an outer layer and an inner layer; the outer layer comprises any one of an oriented polypropylene (OPP) layer having a thickness of from 15 μm to 60 μm, a polyethylene terephthalate (PET) layer having a thickness of from 9 μm to 25 μm and a vacuum metalization oriented polypropylene (VMOPP) layer having a thickness of from 9 μm to 50 μm; and the inner layer comprises a fusion-bonding layer having a thickness of from 1 μm to 10 μm, the fusion-bonding layer being formed integrally with the outer layer, it is possible to improve the fusion-bonding property of a portion of the laminate film, which is to be fusion-bonded.

There is preferably adapted a structure that the laminate film comprises an outer layer and an inner layer; the outer layer comprises any one of an oriented polypropylene (OPP) layer having a thickness of from 15 μm to 60 μm, a polyethylene terephthalate (PET) layer having a thickness of from 9 μm to 25 μm and a vacuum metalization oriented polypropylene (VMOPP) layer having a thickness of from 9 μm to 50 μm; and the inner layer comprises a fusion-bonding layer having a thickness of from 1 μm to 10 μm, the fusion-bonding layer being formed on a prescribed portion. The formation of the fusion-bonding layer serving as the inner layer on the prescribed portion of the inner layer can improve the fusion-bonding property of the portion on which the fusion-bonding layer is to be formed.

There may be adapted a structure that the laminate film comprises an outer layer, an intermediate layer and an inner layer; the outer layer comprises a polyethylene terephthalate (PET) layer having a thickness of from 9 μm to 25 μm; the intermediate layer comprises an aluminum (Al) layer having a thickness of from 5 μm to 15 μm; and the inner layer comprises any one of a polyethylene (PE) layer and a nonoriented polypropylene (CPP) layer, which have a thickness of from 15 μm to 70 μm. Such a structure is preferably suitable for a container for receiving retort pouch food.

DETAILED DESCRIPTION OF THE PREFERRED EMBODIMENTS

Now, embodiments of a self-standing container of the present invention will be described in detail below with reference to the accompanying drawings.

The method for manufacturing the self-standing bag is proposed in Japanese Patent Application Nos. H6-114,803 and H8-25,603 and Japanese Utility Model Application No. H4-40,497, which were filed in the name of the applicant.

Figure 1:
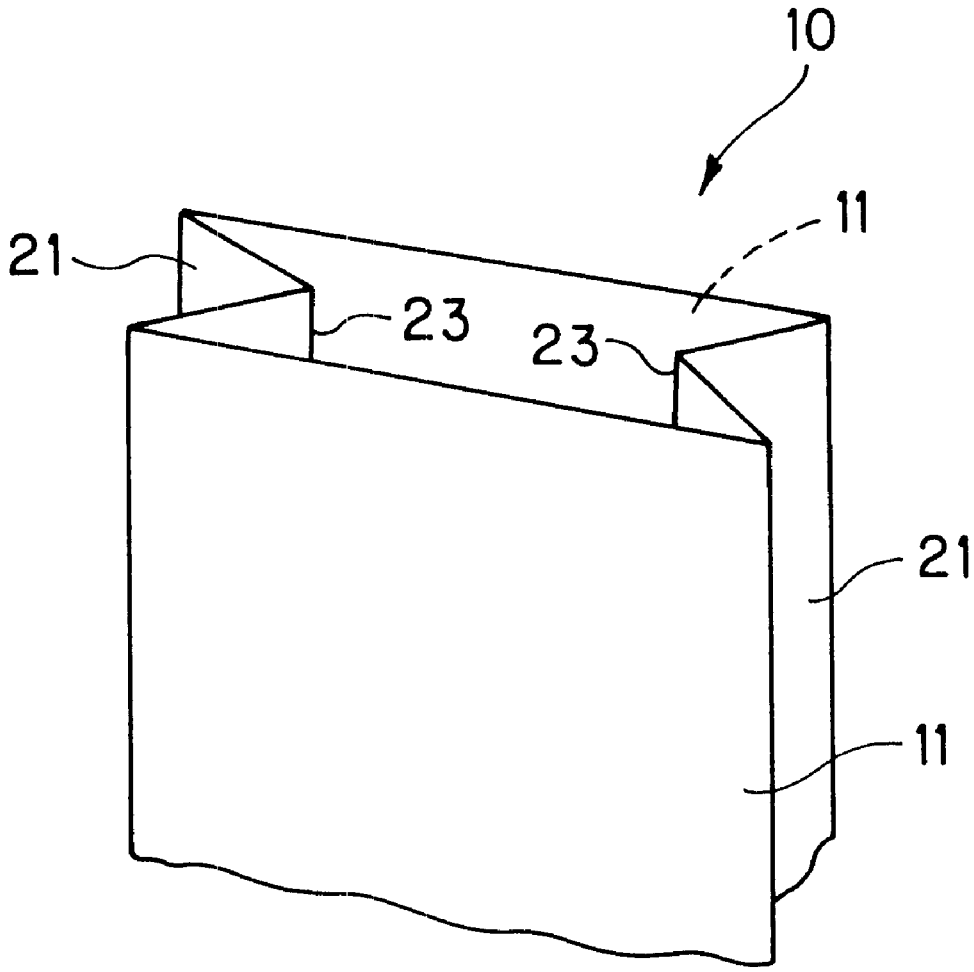
FIG. 1 is a partial perspective view of a main body of a self-standing container of the first embodiment of the present invention.
Figure 2:
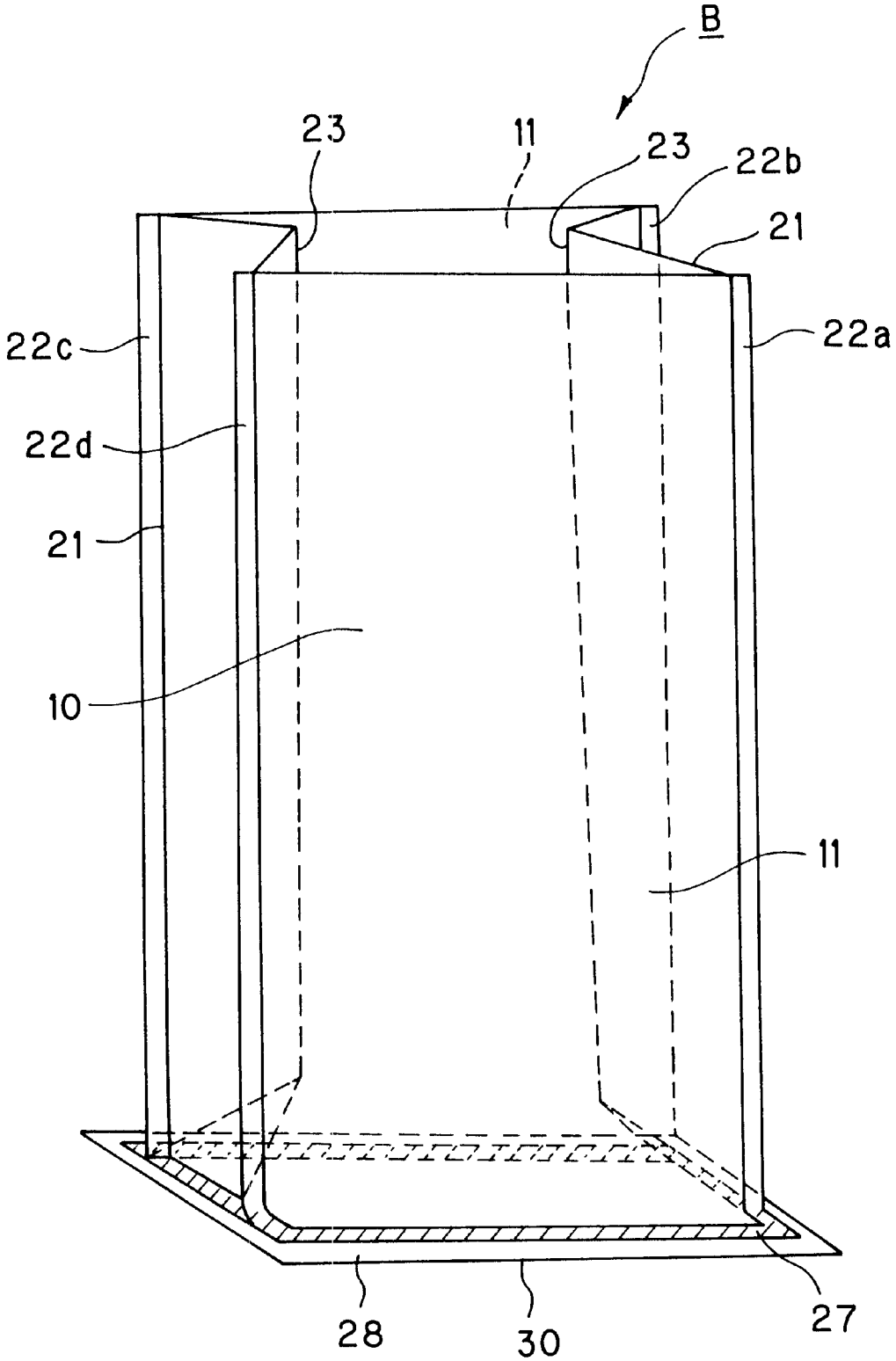
FIG. 2 is a perspective view of the self-standing container of the first embodiment of the present invention in a state that the upper end portion is opened.

More specifically, in the above-mentioned three applications, there is proposed the method for manufacturing the self-standing bag B by combining a tubular shaped main body 10 as shown in FIG. 1, which has (i) a pair of flat face members 11, 11 facing each other so as to form the front and rear faces of the bag, respectively, and (ii) two side face members 21, 21, each of which is folded inward toward the interior of the container along a folding line 23 to form a creased portion, with a bottom-forming sheet 30 for forming the flat bottom as shown in FIG. 2.

The main body 10 is provided in its four comers with four fusion-bonded columnar portions 22*a*, 22*b*, 22*c* and 22*d* having a prescribed width, which are formed by fusion-bonding the flat face members 11, 11 to the side face members 21, 21. The fusion-bonding of the bottom-forming sheet 30 to the periphery of the open end portion of the main body 10 forms a fusion-bonded portion 27 having a prescribed width (as shown in hatching in FIG. 2). An extended portion 28 having a prescribed width extends from the outer periphery of the fusion-bonded portion 27. The framework structure having a prescribed strength, which is obtained by the fusion-bonded columnar portions 22*a*, 22*b*, 22*c* and 22*d* as well as the framework structure having a prescribed strength, which is obtained by the fusion-bonded portion 27 of the bottom-forming sheet 30 can provide the self-standing property of the container.

Figure 3:
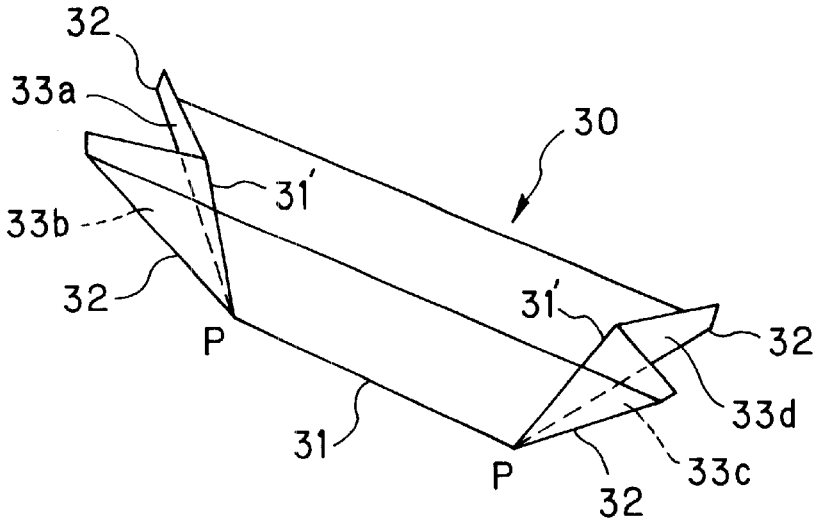
FIG. 3 is a perspective view of a bottom-forming sheet of the self-standing container of the first embodiment of the present invention.

The method disclosed in Japanese Patent Application No. H6-114,803, i.e., the first method comprises the steps of preparing a bottom-forming sheet 30 having a rectangular shape as shown in FIG. 3; folding the bottom-forming sheet 30 in two along its longitudinal central line to form a bottom folding line 31; and folding the opposite side portions of the bottom-forming sheet 30 in the opposite direction to the folding direction of the above-mentioned bottom-forming sheet 30, along lines extending on the bottom folding line 31 from prescribed two basic points P, P to the opposite side edges of the bottom-forming sheet 30, respectively, so as to form the opposite inward ridgelines 31', 31' as well as four outward ridgelines 32, 32, 32, 32 extending from the above-mentioned basic points P, P to the four corners or their vicinities of the bottom-forming sheet 30, thereby forming gusset portions 33*a*, 33*b*, 33*c*, 33*d* of the bottom-forming sheet, which correspond to the creased portions of the side face members 21, 21.

Figure 4:
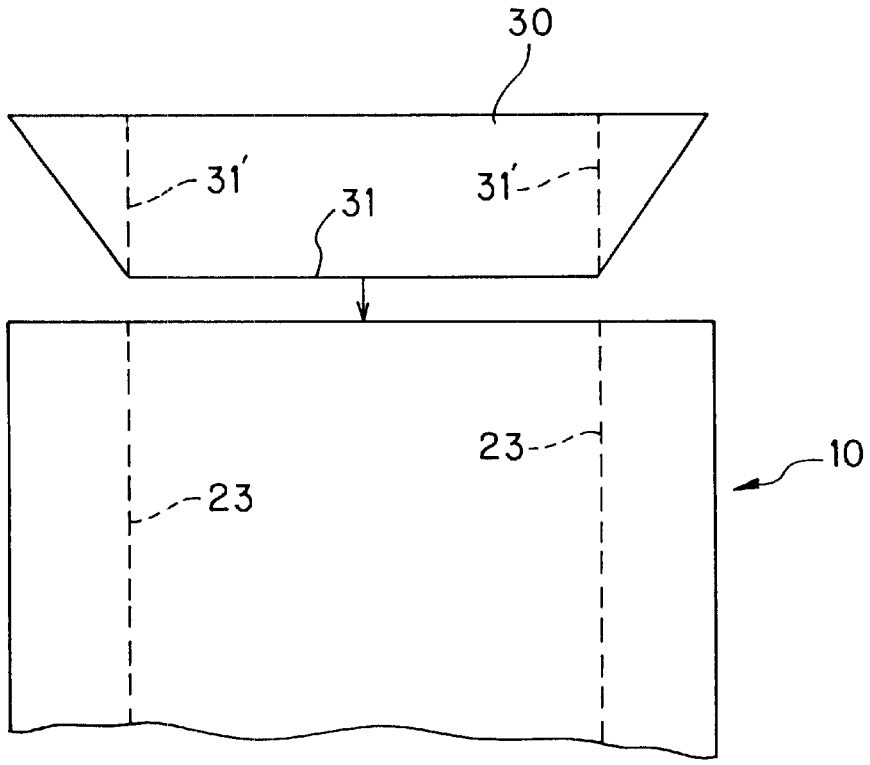
FIG. 4 is a descriptive view of the assembly of the self-standing container of the first embodiment of the present invention.

Then, the bottom-forming sheet 30, which has been subjected to the above-mentioned folding steps, is inserted into at least one of the opposite open end portions of the main body 10 as shown in FIG. 4 so that the inward ridgelines 31', 31' of the bottom-forming sheet 30 coincide with the folding lines 23, 23 of the main body 10.

Figure 5:
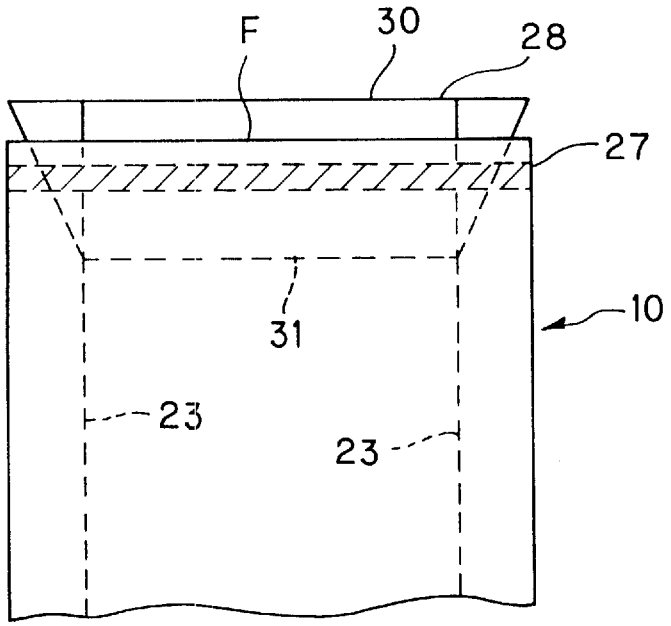
FIG. 5 is another descriptive view of the assembly of the self-standing container of the first embodiment of the present invention.

Then, a heating plate is pressed against the main body 10 and the bottom-forming sheet 30 so as to fusion-bond the periphery of the open end portion of the main body 10 to the gusset portions 33*a*, 33*b*, 33*c*, 33*d* of the bottom-forming sheet as shown in FIG. 5. The fusion-bonded portion 27 is shown in hatching in FIG. 5. Such a fusion-bonding process is usually carried out by the side fusion-bonding step for the main body 10. The extended portion 28 of the bottom-forming sheet 30 is cut off along a line F, as an occasion demands. The self-standing bag as shown in FIG. 2 can be formed in this manner.

Figure 6:
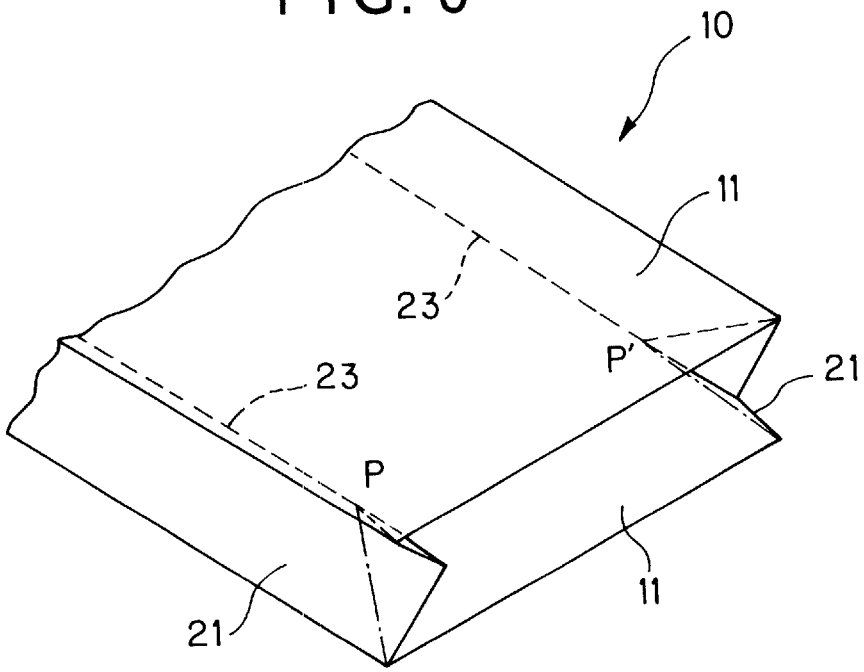
FIG. 6 is a perspective view illustrating the bottom end portion of the main body of the self-standing container of the second embodiment of the present invention.
Figure 7:
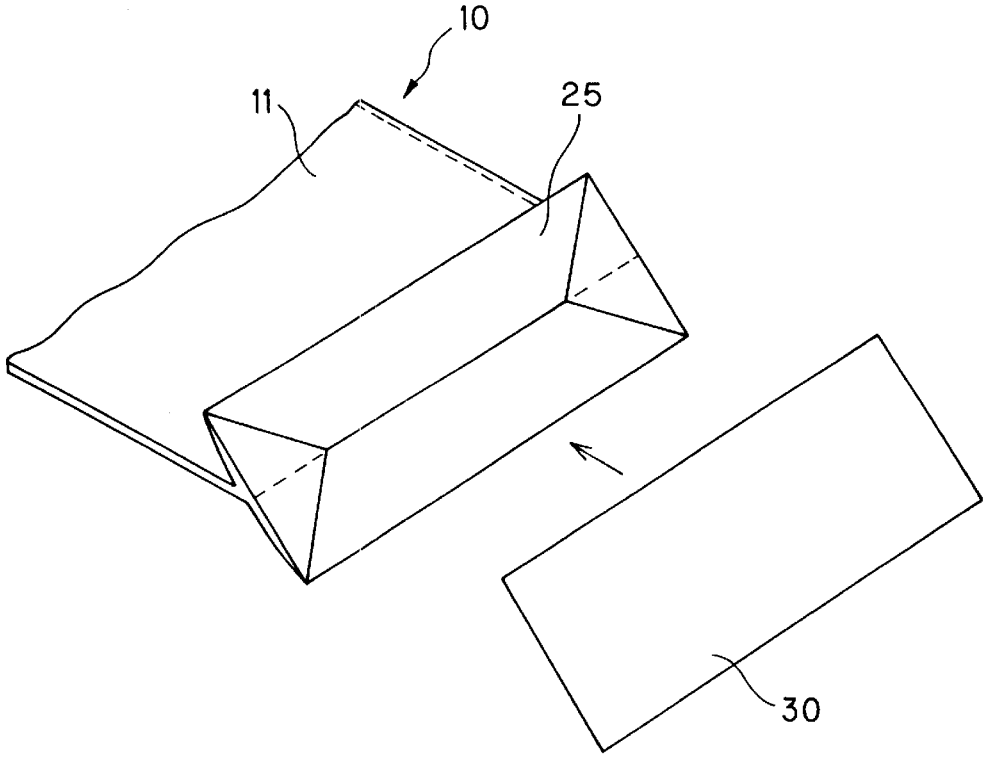
FIG. 7 is a descriptive view of assembling the bottom of the self-standing standing container of the second embodiment of the present invention.
Figure 8:
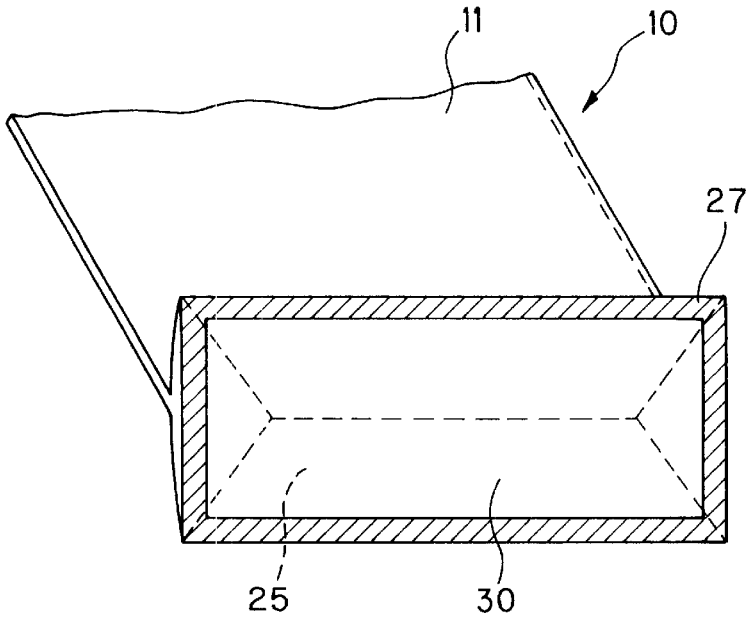
FIG. 8 is another descriptive view of assembling the bottom of the self-standing container of the second embodiment of the present invention.

The method disclosed in Japanese Patent Application No. H8-25,603, i.e., the second method comprises the step of folding outward the opposing end portions of the side face members 21, 21 as shown in FIG. 6, which locate on the side of the open end portion of the main body 10, along lines extending on the folding lines 23, 23 from prescribed two basic points P, P' to the edges of the side face members 21, 21, respectively, so as to prepare the main body 10 in a folding state, which is provided with a rectangular exposed portion 25 as shown in FIG. 7.

A flat bottom-forming sheet 30 having a rectangular shape is prepared as shown in FIG. 7 and is placed on the above-mentioned exposed portion 25.

A heating plate is pressed against the exposed portion 25 and the bottom-forming sheet 30 so as to fusion-bond the periphery of the open end portion of the main body 10 to the bottom-forming sheet 30, thus forming the fusion-bonded portion 27. The self-standing bag as shown in FIG. 2 can be formed also in this manner.

Figure 9:
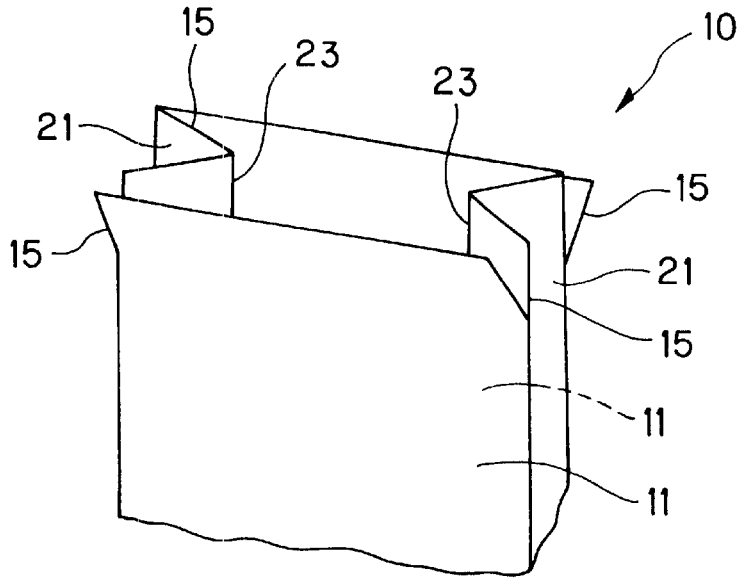
FIG. 9 is a perspective view of the bottom end portion of the main body of the self-standing container of the third embodiment of the present invention.

The method disclosed in Japanese Patent Application No. H4-40,497, i.e., the third method comprises the step of forming cuts 15, 15, 15, 15 as shown in FIG. 9 in the four corners of the open end portion of the main body 10 so as to extend downward from the upper ends of the connection portions of the flat face members 11, 11 of the main body 10 with the side face members 21, 21 thereof by a prescribed distance. These cuts 15, 15, 15, 15 have substantially the identical depth with each other. Such a cut-forming step can especially provide useful effects of achieving an easy manufacturing operation for the bag and adjusting the shape of a product by a cutting operation mentioned later.

Figure 10:
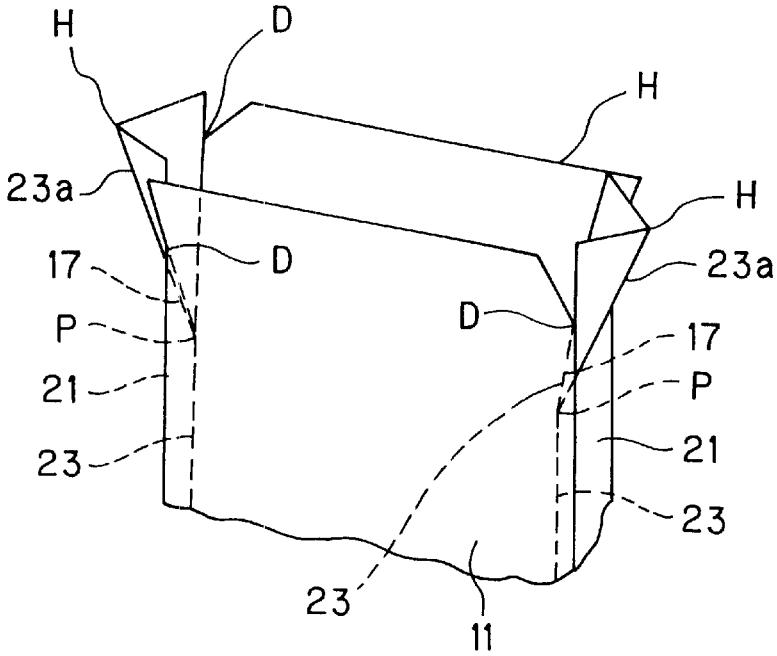
FIG. 10 is a descriptive view of assembling the bottom of the self-standing container of the third embodiment of the present invention.

Then, the upper portions of the side face members 21, 21 are folded in the opposite direction to the folding direction of the side face members 21, 21 as shown in FIG. 10, along lines that extend from prescribed two basic points P, P existing on the folding lines 23, 23 to the upper ends H, H thereof, so as to form outward ridgelines 23*a*, 23*a*, while pulling the upper portions of the side face members 21, 21 outward. Such a folding step forms four inward ridgelines 17, 17, 17, 17, which extend from the lower edges D of the cuts 15, 15, 15, 15 to the basic points P, P.

Figure 11:
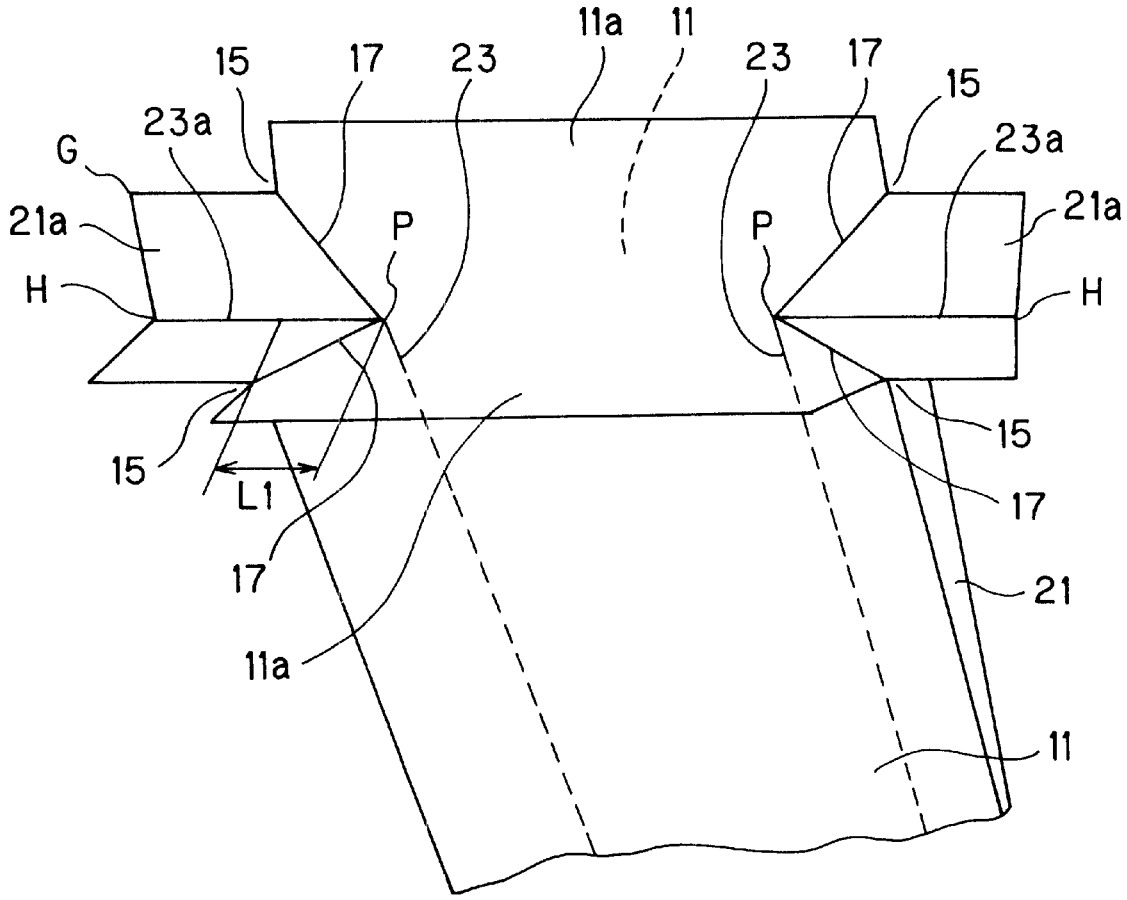
FIG. 11 is another descriptive view of assembling the bottom of the self-standing container of the third embodiment of the present invention.

The above-mentioned folding step causes the inner surface of the main body 10 to be exposed so as to form exposed portions 11*a*, 11*a*, 21*a*, 21*a*. In the embodiment of the present invention, the position of each basic point P is determined so that the segment GH as shown in FIG. 11 has the same length as the folding length L1.

Figure 12:
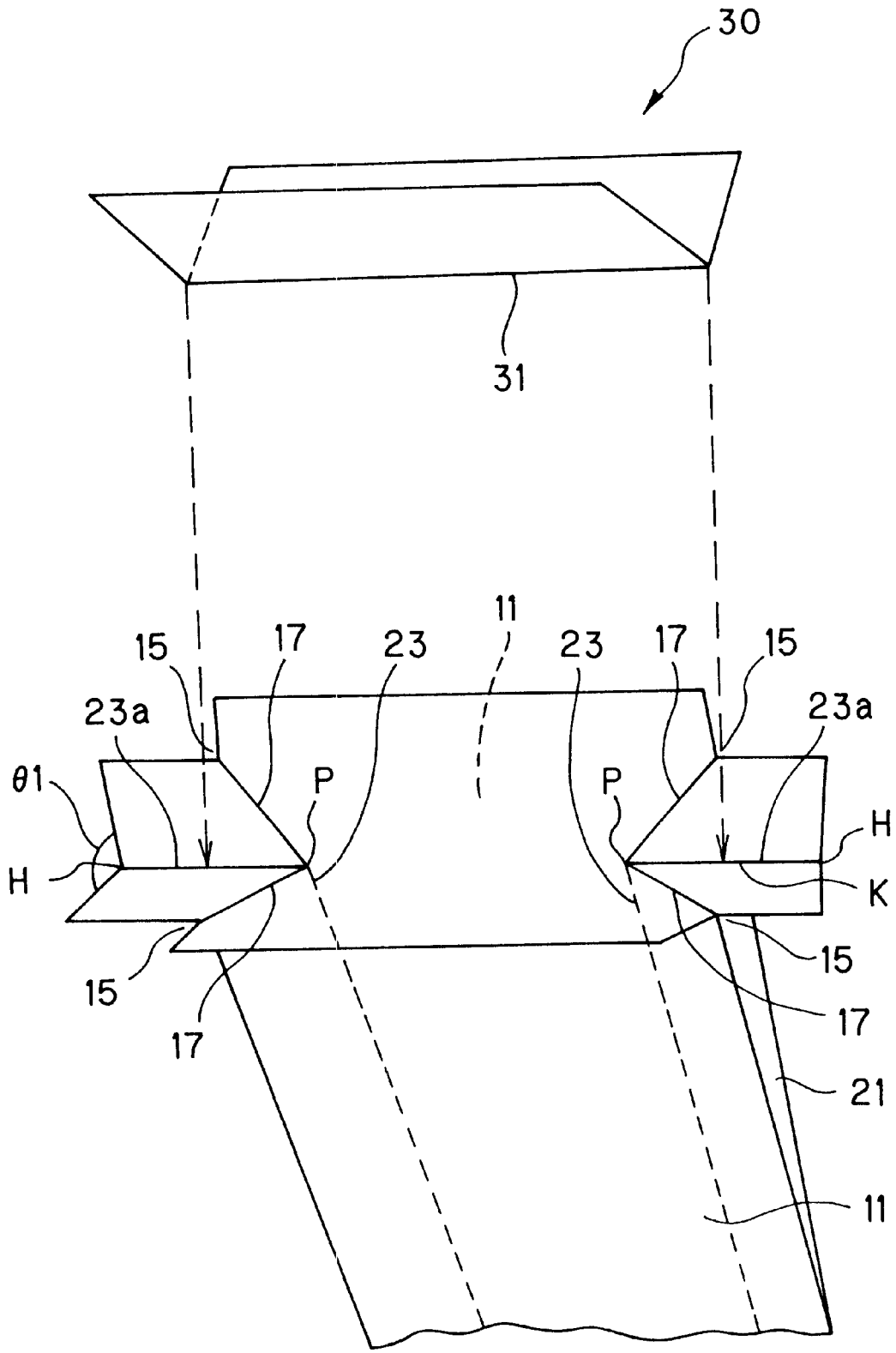
FIG. 12 is further another descriptive view of assembling the bottom of the self-standing container of the third embodiment of the present invention.

A rectangular bottom-forming sheet 30 having a folding line 31 formed along the central line extending in its longitudinal direction is placed above the exposed portions 11*a*, 11*a*, 21*a*, 21*a*. as shown in FIG. 12. In the embodiment of the present invention, the bottom-forming sheet 30 has substantially the same size as the standard rectangular, which is defined by the two outside corners of the exposed portion 11*a* and the two outside corners of the other exposed portion 11*a*. The bottom-forming sheet 30 may have the larger size than the above-mentioned standard rectangular.

Figure 13:
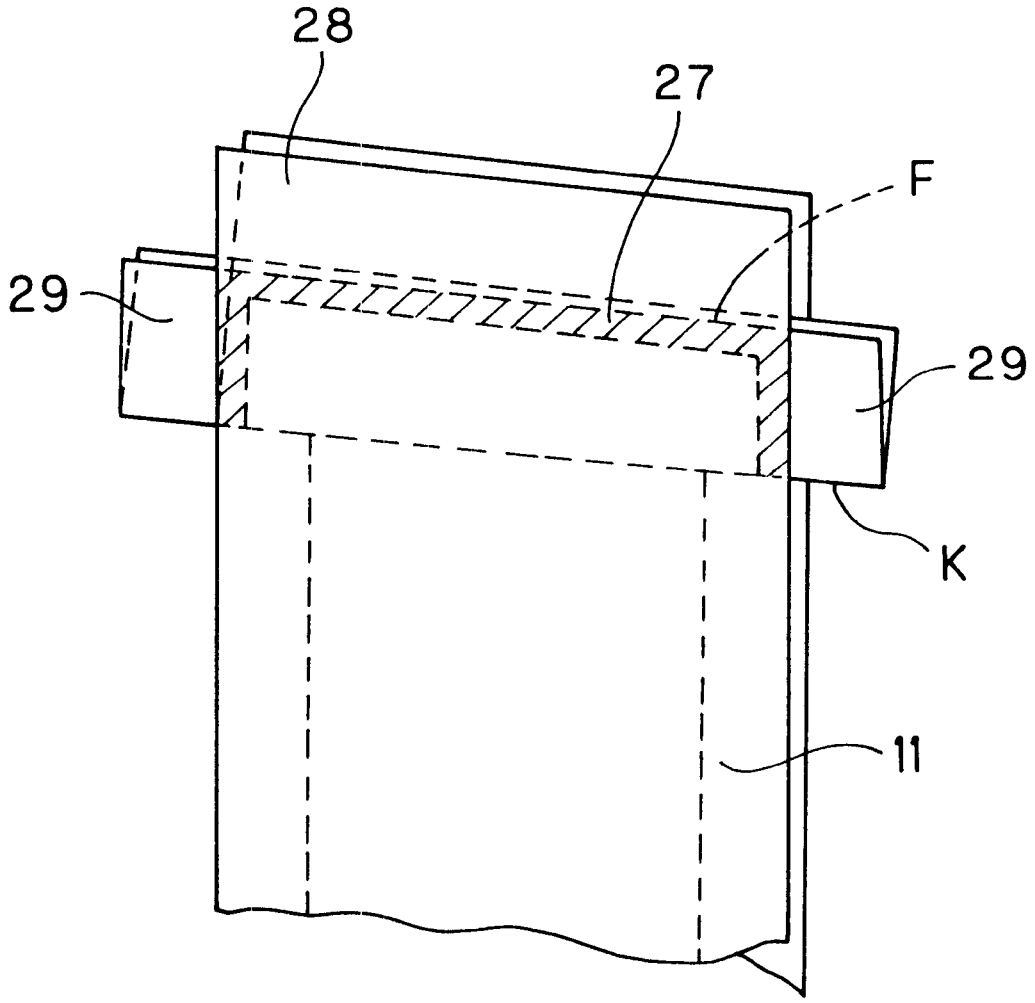
FIG. 13 is still further another descriptive view of assembling the bottom of the self-standing container of the third embodiment of the present invention.
Figure 14:
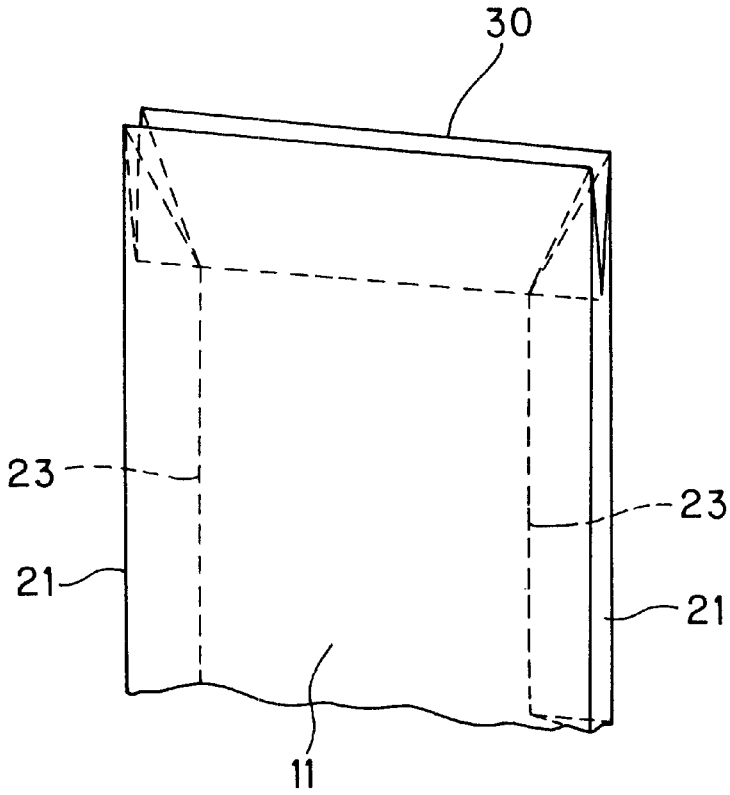
FIG. 14 is still further another descriptive view of assembling the bottom of the self-standing container of the third embodiment of the present invention.

Then, the rectangular bottom-forming sheet 30 is placed on the exposed portions 11*a*, 11*a*, 21*a*, 21*a* so that the four corners of the bottom-forming sheet 30 coincide with the two outside corners of the exposed portion 11*a* and the two outside corners of the other exposed portion 11*a* as shown in FIG. 12. Such placement can easily be made by aligning the folding line 31 of the bottom-forming sheet 30 with a reference line K connecting the ends H, H of the main body 10 with each other. Then, the bottom-forming sheet 30 is folded along the reference line K together with the exposed portions 11*a*, 11*a*, 21*a*, 21*a* so that the side edges of the bottom-forming sheet 30 come close to each other as shown in FIG. 13. Then, a heating plate is pressed against the bottom-forming sheet 30 to heat-seal the entire periphery thereof, thus forming the fusion-bonded portion 27 (as shown in hatching in FIG. 13). Such a fusion-bonding process is usually carried out by the side fusion-bonding step. Then, tab portions 29, 29, which extend from the opposite side edges of the main body as shown in FIG. 13, are cut off along the vertical lines coinciding with the side edges of the main body (see FIG. 14). Then, the extended portions 28, which extend from the bottom of the main body as shown in FIG. 13, are cut off in the horizontal direction along the line F (see FIG. 14). The self-standing bag B as shown in FIG. 2 can also be formed in this manner.

According to the self-standing bag B, the framework structure provided in the bottom-forming sheet 30, which is obtained by fusion-bonding the bottom-forming sheet 30 to the open end portion of the main body 10, and the framework structure that is composed of the fusion-bonded columnar portions 22*a*, 22*b*, 22*c* and 22*d* provided in the four corners of the main body 10 make it possible to maintain the proper shape of the bag, even when the main body 10 and the bottom-forming sheet 30 have a relatively small thickness. The fusion-bonded portion 27 (as shown in hatching in FIG. 2) that is formed by fusion-bonding the bottom-forming sheet 30 to the main body 10 having the fusion-bonded columnar portions 22*a*, 22*b*, 22*c* and 22*d* provides a hoop structure. As a result, even when the bag receives the contents having a relatively large bulk specific gravity, the stable self-standing property can be provided.

In the bags obtained by the above-described methods or methods similar thereto, the cooperative functions of the flat bottom and the gussets provided on the opposite sides of the bag can provide the bag with a structure having a low gravity and a stability. As a result, an excellent self-standing property can be provided. The bag can stand for itself, even when it has a large capacity and the main body 10 and the bottom-forming sheet 30 have a relatively small thickness. With respect to the bag having a more excellent self-standing property, it is possible to decrease further the thickness of the wall portions of the bag, i.e., the main body 10 and the bottom-forming sheet 30.

The present invention was made from the point of view described above on the basis of the point of decreasing the thickness of the wall portions of the bag, to which attention was directed. According to the self-standing container of the present invention, it is possible to reduce the weight and the cost of the container, and improve waste disposability as well as handling and convenience property.

The self-standing container of the present invention is composed of the tubular shaped main body 10 having the opposite open-end portions and of the bottom-forming sheet 30. The bottom-forming sheet 30 is joined to the periphery of the lower open-end portion of the main body 10 by a fusion-bonding method to form a flat bottom. The above-described methods or methods similar thereto can be applied as an appropriate method for forming the above-mentioned flat bottom. Each of the main body 10 and the bottom-forming sheet 30 is formed of a laminate film having at least two layers.

Figure 15:
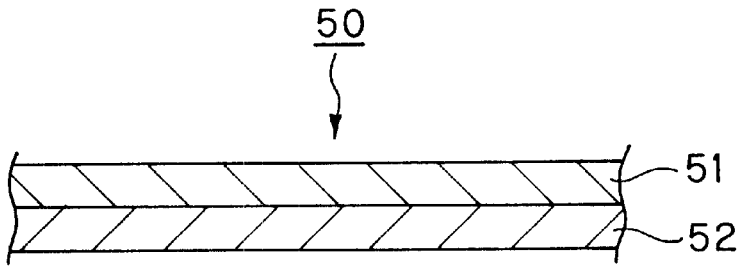
FIG. 15 is a cross-sectional view of the laminate film of which the self-standing container of the present invention is formed.

FIG. 15 is a cross-sectional view of the laminate film 50 of which the self-standing container of the present invention is formed. The laminate film 50 used in the present invention comprises an outer layer 51 and an inner layer 52. A fusion-bonding layer may be provided in order to improve the fusion-bonding property, as an occasion demands. A transparent laminate film 50 may be used in order to permit to see through the contents received in the container. There may be adopted, depending on the use of the bag, a three-layer structure in which an intermediate layer is formed between the outer layer 51 and the inner layer 52. A printing layer may be formed between the outer layer 51 and the inner layer 52, as an occasion demands. Such a printing layer may be formed in any position between the outer layer 51 and the inner layer 52 by mean of the conventional printing method. The printing layer is usually formed by applying a printing method to the back surface of the outer layer 51 so that the formed container has an excellent appearance as well as an excellent displaying property.

Figure 16:
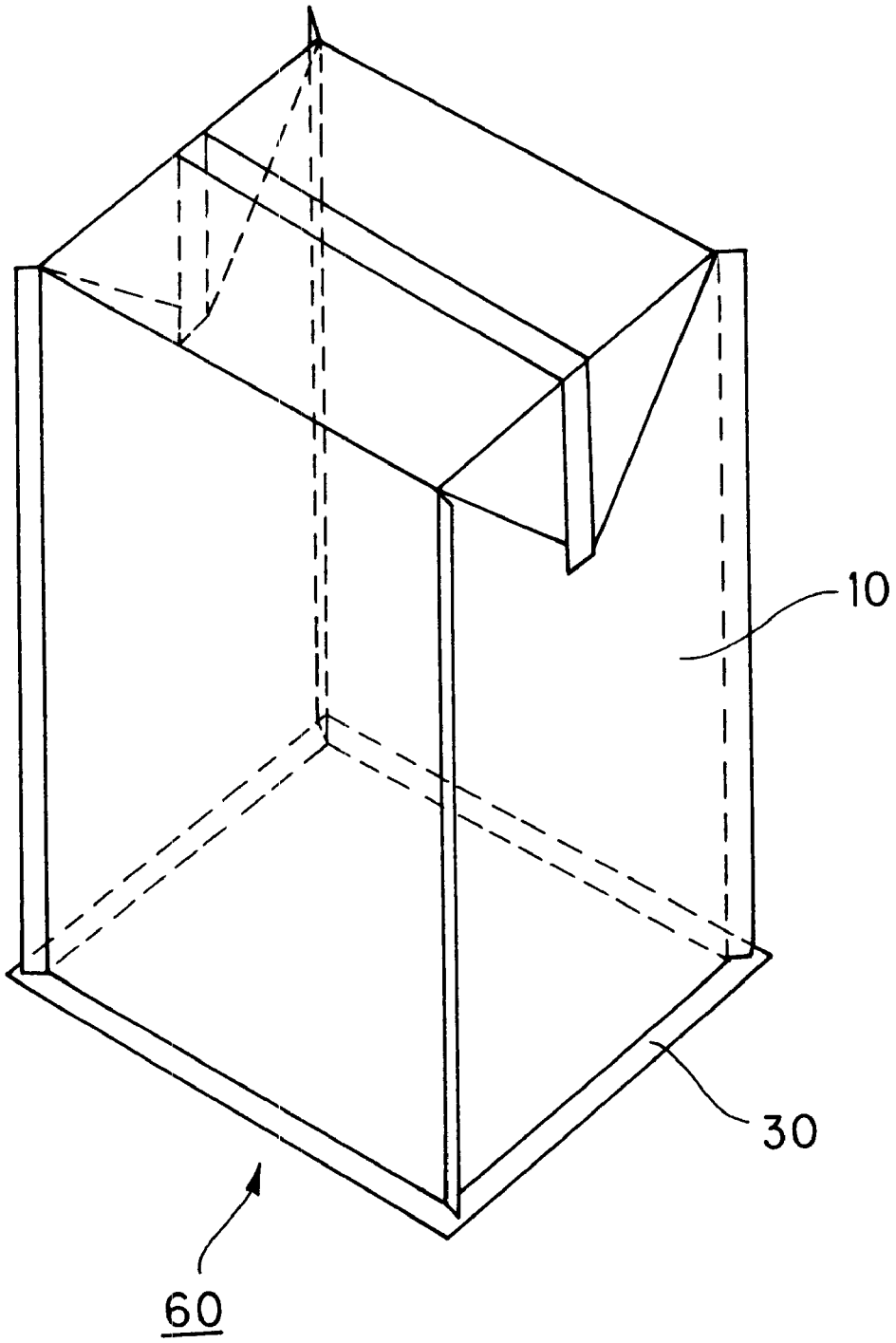
FIG. 16 is a perspective view of the self-standing container of the using-up type of the present invention.
Figure 17:
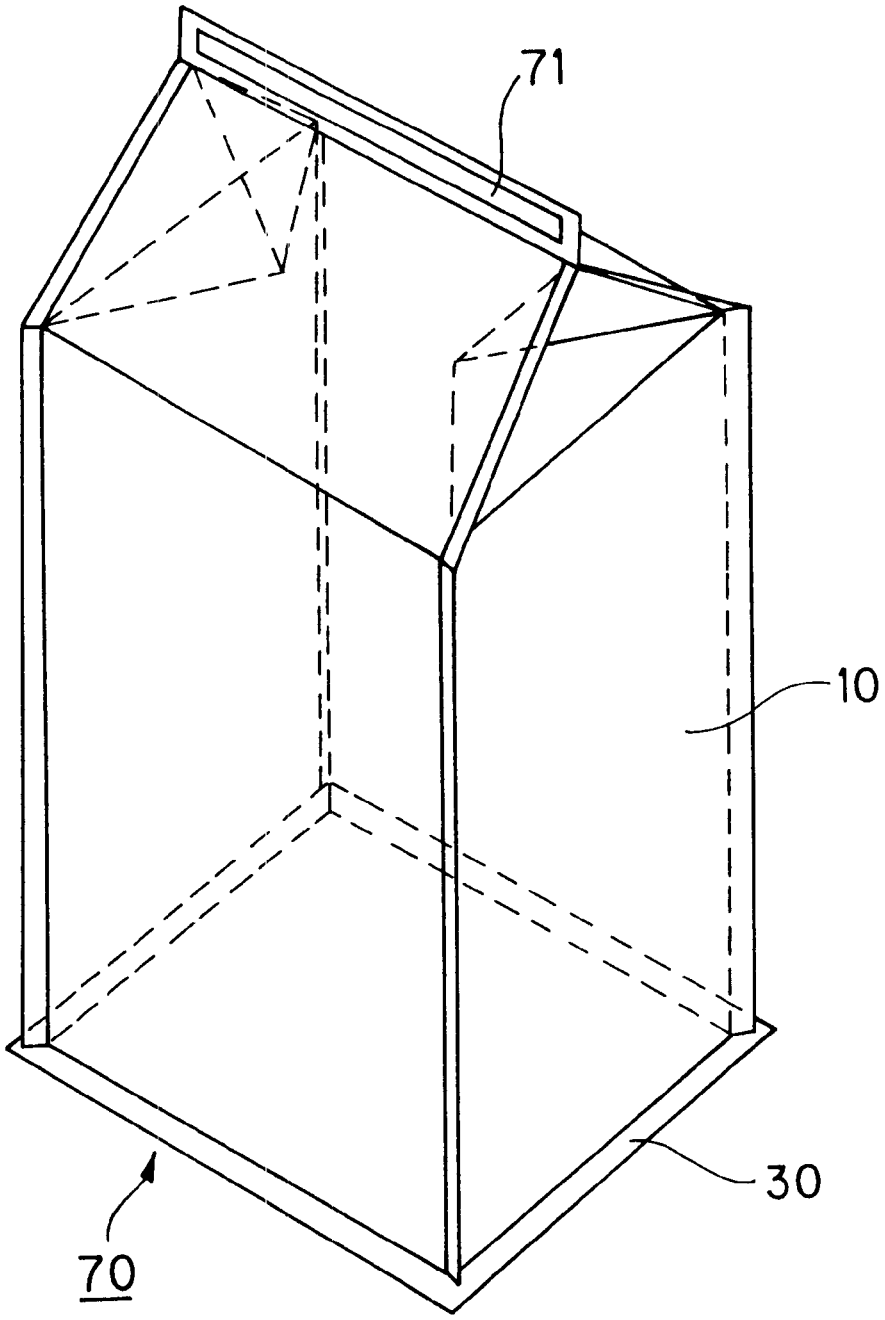
FIG. 17 is a perspective view of the self-standing container of the present invention, which has a gable roof provided with a fastener.

The upper end portion of the container is sealed by means of a fusion-bonding method as in the conventional manner. A sealing member may be provided in the upper end portion of the container so that the container can be kept in a sealed condition again after a part of the contents, i.e., solid, powdery or granular material or the like is pulled out of the container. The sealing member preferably comprises a fastener, a cap or the like. FIGS. 16 and 17 are perspective views illustrating examples of the self-standing container of the present invention. Each of the self-standing containers 60, 70 has the flat bottom. The container 60 as shown in FIG. 16 has substantially the same rectangular top shape as the bottom of the container. The container 70 as shown in FIG. 17 has a gable roof-shape. The fastener 71 serving as the sealing member is provided in the top of the gable roof. The fastener 71 may have any kind of conventional resealable closure mechanism, such as a single-track zipper-type mechanism, a dual-track zipper-type mechanism. The dual-track zipper-type mechanism is preferably applied in view of an excellent sealing property. The sealing member may be formed of plastic. The plastic sealing member may be provided in the upper end portion of the container by means of the conventional method, for example, the fusion-bonding method. The formation of the sealing member makes it possible to keep the container in the sealed condition again after a part of the contents is pulled out of the container. The flat bottom of the container ensures the self-standing property, thus improving handling and convenience property, even when the laminate film 50 as used has a small thickness of from 20 $\mu$m to 120 $\mu$m. The container can be resealed after filling it with air so as to maintain the original shape having the self-standing property. As a result, the container can be stored in the original shape even when a small amount of the contents is used at a time.

Figure 18:
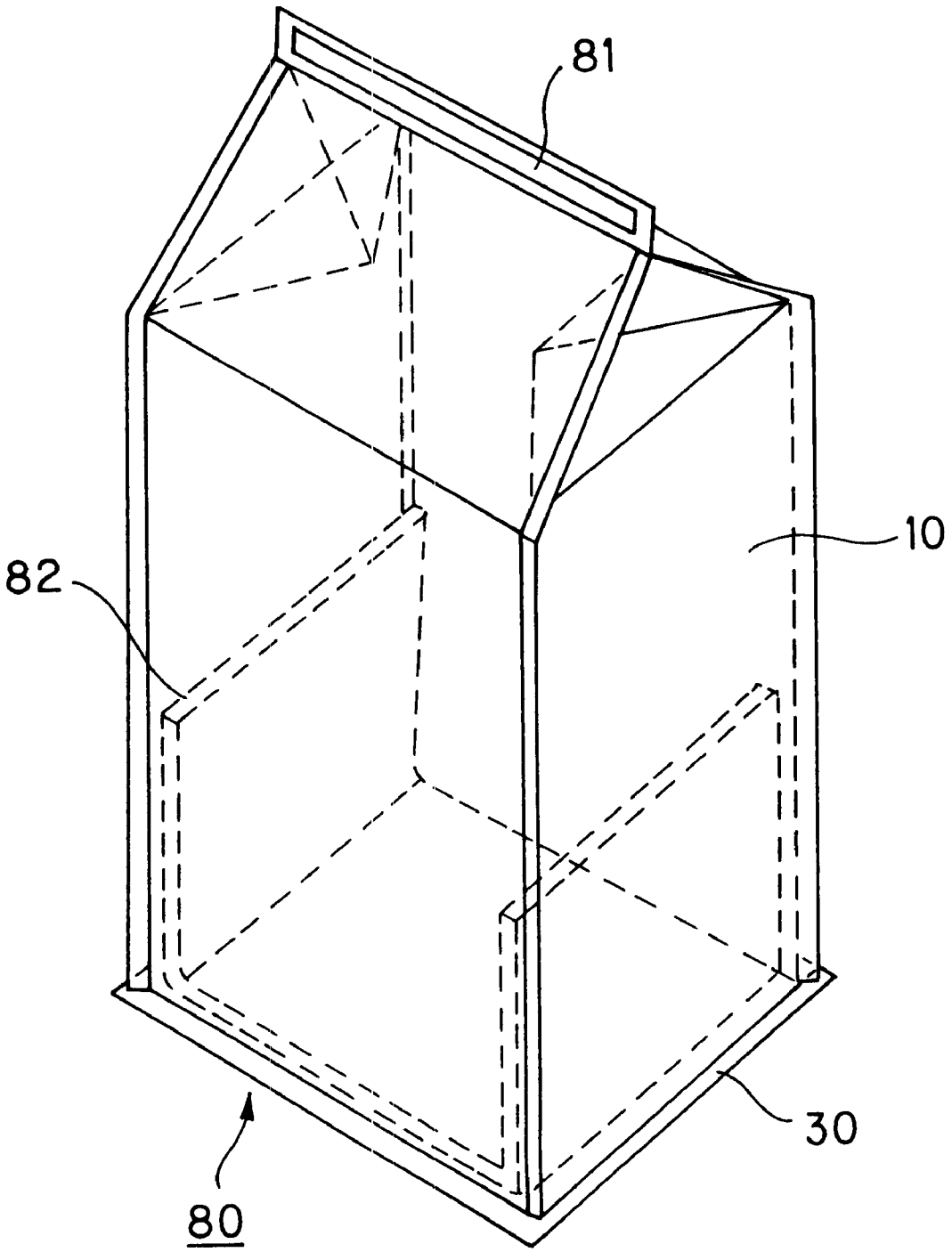
FIG. 18 is a perspective view of the self-standing container of the present invention, which has a holder inserted therein and a gable roof provided with a fastener.

A holder formed of paper for arranging the contents in a proper condition may be inserted in the container. FIG. 18 is a perspective view illustrating an example of the self-standing container 80 of the present invention, in which the holder formed of paper is inserted. The holder 82 preferably has a trough-shape with a U-shaped cross section. The shape of the holder is not limited to the shape described above. The holder may have the other shape, which can provide the same effect. When the container is formed of a transparent laminate film, the residual quantity of the contents received in the container can easily be recognized through the transparent walls of the container, in which the transparency is not disturbed by the holder 82. Printed images or characters formed on the surface of the holder can impart the displaying property to the container. The combination of the self-standing container with the holder formed of paper makes it possible to provide the container having a stable self-standing property and an excellent property of maintaining the form of products without using any container having rigidity.

Figure 19:
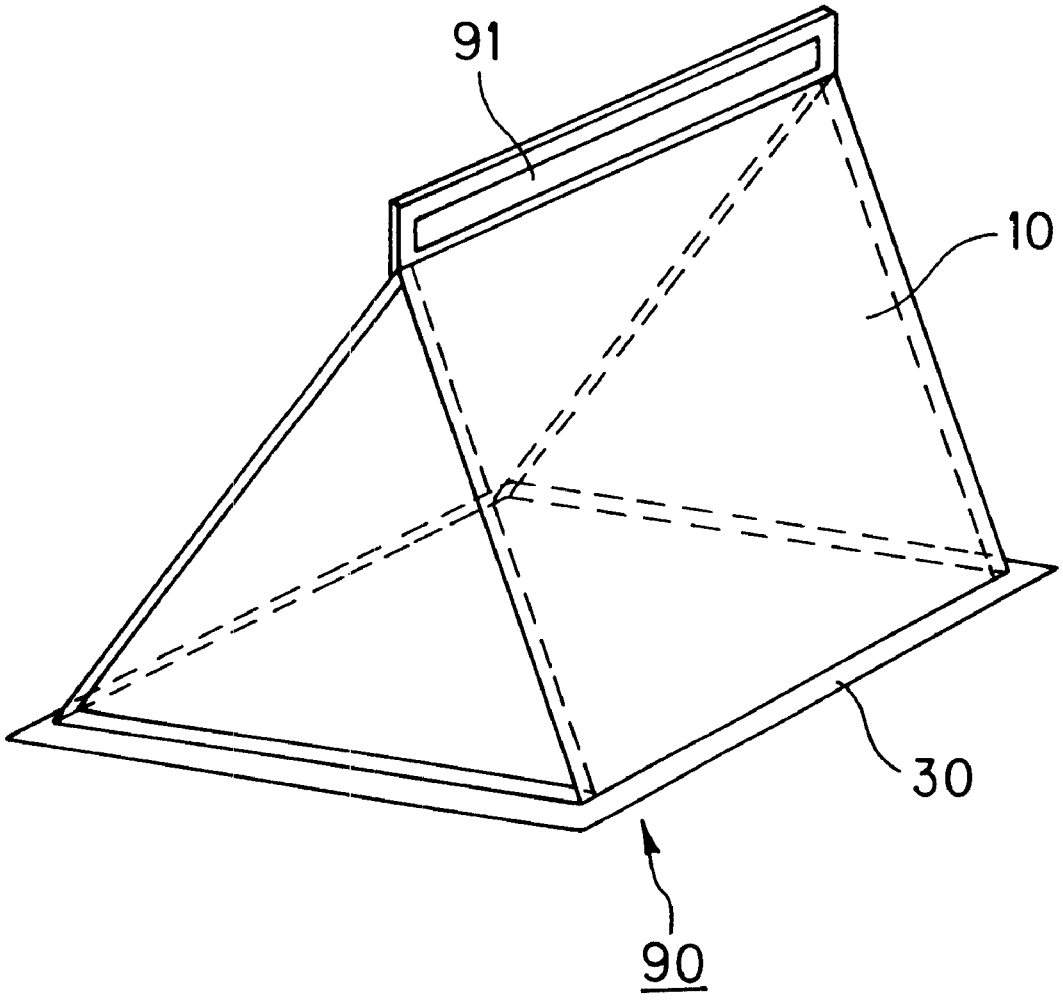
FIG. 19 is a perspective view of the self-standing container of the present invention, which is formed into a gable roof-shape provided with a fastener.

The container may have any shape so long as it has the flat bottom by which the self-standing property can be provided. The container preferably has any one of a hexahedron shape, a gable roof-shape and a combined shape of the hexahedron shape with the gable roof-shape provided on the upper end of the hexahedron shape. FIG. 19 is a perspective view illustrating the container, which is formed into the gable roof-shape and has at its top end portion a zipper-type resealable closure mechanism 91 serving as the sealing member.

The laminate film 50 as used having the thickness of from 20 $\mu$m to 120 $\mu$m may be obtained by the combination of at least two layers, taking into consideration the characteristic properties of the layers subjected to the lamination process, for example, gas-barrier property, moisture proofing property, heat-resistant property and fusion-bonding property, as well as the kind of the contents to be received in the container and their handling method. The thickness of the laminate film 50 is preferably as small as possible, provided that the self-standing property of the container as manufactured can be ensured. With the excessively small thickness, the respective characteristic properties of the layers forming the laminate film 50 cannot sufficiently be ensured. In view of these facts, the lower limit of the thickness of the laminate film 50 is determined as mentioned above, so as to maintain the self-standing property of the container and ensure the characteristic properties of the layers. The upper limit of the thickness of the laminate film 50 is determined as mentioned above in view of the flexibility of the laminate film 50.

The laminate film 50 is composed of the layers having their inherent characteristic properties, taking into consideration the kind of the contents to be received in the container and their handling method. With respect to the combination of the layers, the laminate film 50 is preferably composed of two layers, i.e., (i) the outer layer 51 comprising any one of an oriented polypropylene (OPP) layer having a thickness of from 15 μm to 60 μm, a polyethylene terephthalate (PET) layer having a thickness of from 9 μm to 25 μm and a vacuum metalization oriented polypropylene (VMOPP) layer having a thickness of from 9 μm to 50 μm and (ii) the inner layer 52 comprising a non-oriented polypropylene (CPP) layer having a thickness of from 15 μm to 80 μm. For the container for receiving retort pouch food, the laminate film may be composed of three layers, i.e., (i) the outer layer 51 comprising a polyethylene terephthalate (PET) layer having a thickness of from 9 μm to 25 μm, (ii) the intermediate layer comprising an aluminum (Al) layer having a thickness of from 5 μm to 15 μm and (iii) the inner layer 52 comprising any one of a polyethylene (PE) layer and a non-oriented polypropylene (CPP) layer, which have a thickness of from 15 μm to 70 μm.

With respect to another combination of the layers for the laminate film 50, the outer layer 51 comprising any one of an oriented polypropylene (OPP) layer having a thickness of from 15 μm to 60 μm, a polyethylene terephthalate (PET) layer having a thickness of from 9 μm to 25 μm and a vacuum metalization oriented polypropylene (VMOPP) layer having a thickness of from 9 μm to 50 μm is preferably combined with the inner layer 52, which comprises a fusion-bonding layer having a thickness from 1 μm to 10 μm and is formed integrally with the outer layer 51. The fusion-bonding layer, which is formed integrally with the outer layer 51 so as to serve as the inner layer 52, can improve the fusion-bonding property of the laminate film 50 in its region to which the fusion-bonding step is applied. The fusion-bonding layer ensures the formation of a fusion-bonded portion, for example, the fusion-bonded columnar portions 22*a*, 22*b*, 22*c* and 22*d* formed in the four corners of the main body 10 and the fusion-bonded portion 27 formed by the main body 10 and the bottom-forming sheet 30, in a proper manner.

The fusion-bonding layer formed as the inner layer 52 is an amorphous polypropylene layer in case where the outer layer 51 is any one of an oriented polypropylene (OPP) layer and a vacuum metalization oriented polypropylene (VMOPP) layer. The fusion-bonding layer is an amorphous polyethylene terephthalate (PET) layer in case where the outer layer 51 is a polyethylene terephthalate (PET) layer. In each of these cases, the fusion-bonding layer is formed integrally with the outer layer 51. The respective amorphous layer may be formed integrally with the outer layer 51 by a lamination process during manufacturing the oriented film.

The fusion-bonding layer preferably has a thickness of from 1 μm to 10 μm, and more preferably has a thickness of from 2 μm to 5 μm. With the thickness of under 1 μm, the fusion-bonding property cannot be improved. With the thickness of over 10 μm, the stability of manufacturing process of the oriented film is deteriorated and the manufacturing cost is increased. The thickness of the fusion-bonding layer is therefore limited within the range of from 1 μm to 10 μm for these reasons.

With respect to further another combination of layers for the laminate film 50, the outer layer 51 comprising any one of an oriented polypropylene (OPP) layer having a thickness of from 15 μm to 60 μm, a polyethylene terephthalate (PET) layer having a thickness of from 9 μm to 25 μm and a vacuum metalization oriented polypropylene (VMOPP) layer having a thickness of from 9 μm to 50 μm is preferably combined with the inner layer 52, which comprises a fusion-bonding layer having a thickness from 1 μm to 10 μm and is formed on the prescribed portion of the outer layer 51. The fusion-bonding layer formed on the prescribed portion of the outer layer 51 so as to serve as the inner layer 52 can improve the fusion-bonding property of the portion on which the fusion-bonding layer is formed. It is preferable to form the fusion-bonding layer for example on the four comer portions of the main body 10, in which the fusion-bonded columnar portions 22*a*, 22*b*, 22*c* and 22*d* are to be formed respectively, on the portion in which the fusion-bonded portion 27 is to be formed by the main body 10 and the bottom-forming sheet 30 and the other portion to be fusion-bonded.

In this case, the fusion-bonding layer may be formed by the so-called partial coating method of applying amorphous polyethylene terephthalate (PET), amorphous chlorinated polypropylene resin or amorphous ethylene-vinyl acetate copolymer to the prescribed portion of the outer layer 51. The thickness of the fusion-bonding layer formed on the prescribed portion is preferably within the range of from 1 μm to 10 μm, and more preferably within the range of from 2 μm to 5 μm in the same manner as mentioned above.

The fusion-bonding layer serving as the inner layer 52 is formed on the entirety or the prescribed portion of the outer layer 51. There is a basic single-layer structure in which the fusion-bonding layer is formed on the outer layer 51. Further another outer layer may be formed on the outer surface of the outer layer 51 to provide a multiple layer structure of the combination of the outer layer 51 having the fusion-bonding layer with the further outer layer, as an occasion demands.

It is preferable to reduce the thickness of each of the layers as small as possible, so long as the manufactured container has the standing property. With the excessively small thickness, the inherent properties of the respective layers cannot sufficiently be ensured and problems of the manufacturing cost cause. Consequently, the lower limit of the thickness of each of the layers is limited to the value mentioned above. The upper limit of the thickness of each of the layers is limited to the value mentioned above in view of flexibility and production cost of the film.

The self-standing container of the present invention is excellent in self-standing property and can be kept in its proper shape. As a result, it is possible to display a large quantity of the product and achieve an effective storage system. The container has a rectangular-tube shape, leading to more excellent storage efficiency in comparison with a container having a circular-cylindrical shape.

The self-standing container of the present invention is excellent in shape maintenance property, stably self-standing property and shape-forming property due to the framework structure, which is obtained by the fusion-bonded columnar portions 22*a*, 22*b*, 22*c* and 22*d* as well as the framework structure, which is obtained by the fusion-bonded portion 27 of the bottom-forming sheet 30, although the laminate film 50 of which the container is formed is a flexible wrapping material having a small thickness. Accordingly, the container of the present invention is adopted to be used as a container for receiving many kinds of solid, powdery or granular material or the like.

There may be used the container in which a tray formed of paper is inserted without using any rigid tray, in order to receive confectionery such as cookies, rice balls, cheese or the like. Such a container can provide effects of maintaining its shape, displaying a large quantity of the product and storing the product in a properly arranged state.

When flowers or toys are received in the container, the container may be filled with gas such as air so as to maintain the shape of the container to protect the contents received therein.

When rice cakes are received in the container, the container may be filed with inert gas such as nitrogen gas or sealed in a vacuum condition.

The container may be used as a container for receiving laver in place of a can for receiving it. It is possible to prevent breakage of the laver and to maintain the proper shapes of the container and the product (i.e., the laver), even after the container is unsealed.

The container may be used as a container for receiving powdery material such as flour, salt, sugar, gardening fertilizer, health food, tea, green tea, coffee, cocoa, powdery milk, cleanser of the like, in place of a rigid container. Such a container is light in weight and excellent in flexibility and waste disposability. A small amount of these contents can be pulled out of the container at a time.

The container may be used as a container that has an excellent self-standing property and is designed for receiving granular material such as rice grains, grain seeds or the like. A small amount of these contents can be pulled out of the container at a time.

When the container is used as a container for receiving powdery seasoning or the like for a business use, there is no need of use of a lined carton, thus leading to an excellent handling and convenience property and an excellent waste disposability.

When the container is used as a container for packets for brew beverage such as tea, medicine packets for granular digestive or cold medicine or the like, it is possible to adopt a wrapping method of placing packets one upon another due to the excellent shape-maintenance property and the excellent self-standing property.

The container may suitably be used as a container for receiving food to be heated by means of a microwave oven, i.e., frozen food such as a shao-mai (i.e., a steamed Chinese pork dumpling wrapped in a thin wheat skin), or retort pouch food such as curry, stew, cooked meat with potato.

EXAMPLES

Example 1

There was prepared a main body 10 formed of a three-layer structure film having a thickness of about 70 $\mu$m, which was composed of an outer layer 51 formed of a polyethylene terephthalate (PET) layer having a thickness of 12 $\mu$m, an intermediate layer formed of an aluminum (Al) layer having a thickness of 9 $\mu$m and an inner layer 52 formed of a non-oriented polypropylene (CPP) layer having a thickness of 50 $\mu$m. The thus prepared main body 10 and a bottom-forming sheet 30 were fusion-bonded to each other to form a self-standing bag for receiving solid, powdery or granular material or the like. The bag was filled with retort pouch food of cooked meat with potato. The upper end portion of the bag was fusion-bonded to prepare a self-standing container 60 of the using-up type as shown in FIG. 16.

The container 60, which has been filled with the contents, had an excellent self-standing property. The hexahedron shape (i.e., the rectangular parallelepiped-shape) of the container made it possible to display a large amount of the products without causing deformation of the containers and store the products in a freezer or a refrigerator. The unsealed container had an excellent handling and convenience property and can easily be subjected to the disposal.

Example 2

There was prepared a main body 10 formed of a two-layer structure film having a thickness of about 65 $\mu$m, which was composed of an outer layer 51 formed of an oriented polypropylene film (OPP) layer having a thickness of 40 $\mu$m and an inner layer 52 formed of a nonoriented polypropylene (CPP) film having a thickness of 25 $\mu$m. The thus prepared main body 10 and a bottom-forming sheet 30 were fusion-bonded to each other to form a bag. A zipper 81 serving as the sealing member was fusion-bonded to the upper portion of the above-mentioned bag to prepare a self-standing container 80 having a gable rood as shown in FIG. 18. A holder 82 formed of paper and having a trough-shape with a U-shaped cross section was inserted in the container 80. The container received laver in a drying state.

The container 80 had an excellent self-standing property. Air with which the container was filled had a cushioning effect to maintain a proper shape of the container, thus protecting the laver. The container could easily be folded into a non-bulky shape in order to be subjected to the disposal. The zipper 81 made it possible to reseal the container after a small amount of the contents was used at a time. The residual quantity of the contents received in the container could easily be recognized through the transparent walls of the container, in which the transparency was not disturbed by the holder 82.

Example 3

There was prepared a main body 10 formed of a two-layer structure film having a thickness of about 66 $\mu$m, which was composed of an outer layer 51 formed of a biaxial oriented polyethylene terephthalate (PET) layer having a thickness of 16 $\mu$m and an inner layer 52 formed of a non-oriented polypropylene (CPP) layer having a thickness of 50 $\mu$m. The thus prepared main body 10 and a bottom-forming sheet 30 were fusion-bonded to each other to form a triangular prism-shaped bag. A zipper 91 serving as the sealing member was fusion-bonded to the upper portion of the above-mentioned bag to prepare a self-standing container 90 in a gable roof shape as shown in FIG. 19. The container 90 received three rice balls having a triangular prism shape.

The container 90 had an excellent self-standing property due to the three peripheral walls thereof. No rigid tray was needed unlike the conventional container. Such a structure of the container 90 provided excellent effects in transportation, display in a large amount of products and storage thereof.

Back printing applied to the outer layer 51 and/or printed images or characters formed on the surface of the holder 82 of the containers of the Examples 1 to 3 could impart the excellent displaying property to the containers. It was also possible to indicate specialized matters on the zippers 71, 81, 91 provided in the upper portions of the containers.

According to the self-standing container of the present invention as described in detail, the flat bottom can provide the self-standing property of the container, even when the laminate film as used has a relatively small thickness, thus improving the handling and convenience property. The small thickness of the laminate film makes it possible to provide the flexible and light container so that the container can be folded in a non-bulky shape to be subjected to the disposal, thus improving the waste disposability. The proper shape of the container can be maintained resulting in no need to use any tray. The total thickness of the laminate film is so relatively small as to improve the fusion bonding efficiency. As a result, it is possible to fill the container with the contents at high speed.

The container can be folded in a single sheet-shape before filling it with the contents so that the volume of the container becomes extremely small. The volume of the container can be reduced to one several tenth as compared with that of the container, which is filled with the contents. It is therefore possible to reduce remarkably the transportation and storage costs of the empty containers.

What is claimed is:

1. A self-standing container comprising:

a main body having a tubular shape, said main body having an upper end portion and a lower end portion, which are opened; and a bottom-forming sheet, which is joined to a periphery of said lower end portion by a fusion-bonding so as to form a self-standing container having a flat bottom, wherein:

each of said main body and said bottom-forming sheet comprises a laminate film having at least two layers serving as an outer layer and an inner layer, respectively, each of said outer layer and said inner layer having a thickness of from 20 μm to 120 μm and said outer layer and said inner layer comprising the same material selected from the group consisting of polypropylene and polyethylene.

2. The self-standing container as claimed in claim 1, further comprising:

a sealing member provided on said upper end portion of said main body.

3. The self-standing container as claimed in claim 2, wherein:

said sealing member comprises a fastener by which the container can be opened or closed.

4. The self-standing container as claimed in claim 1, further comprising:

a holder formed of paper, which is inserted in the container.

5. The self-standing container as claimed in claim 4, wherein:

said holder has a trough-shape with a U-shaped cross section.

6. The self-standing container as claimed in claim 1, wherein:

said self-standing container has any one of a hexahedron shape, a gable roof-shape and a combined shape of the hexahedron shape with the gable roof-shape provided on an upper end of the hexahedron shape.

7. The self-standing container as claimed in claim 1, wherein:

said outer layer comprises a material selected from the group consisting of an oriented polypropylene (OPP) layer having a thickness of from 15 μm to 60 μm, a polyethylene terephthalate (PET) layer having a thickness of from 9 μm to 25 μm, and a vacuum metalization oriented polypropylene (VMOPP) layer having a thickness of from 9 μm to 50 μm; and said inner layer comprises a non-oriented polypropylene (CPP) layer having a thickness of from 15 μm to 80 μm.

8. The self-standing container as claimed in claim 1, wherein:

said outer layer comprises a material selected from the group consisting of an oriented polypropylene (OPP) layer having a thickness of from 15 μm to 60 μm, a polyethylene terephthalate (PET) layer having a thickness of from 9 μm to 25 μm, and a vacuum metalization oriented polypropylene (VMOPP) layer having a thickness of from 9 μm to 50 μm; and said inner layer comprises a fusion-bonding layer having a thickness of from 1 μm to 10 μm, said fusion-bonding layer being formed integrally with said outer layer.

9. The self-standing container as claimed in claim 1, wherein:

said outer layer comprises a material selected from the group consisting of an oriented polypropylene (OPP) layer having a thickness of from 15 μm to 60 μm, a polyethylene terephthalate (PET) layer having a thickness of from 9 μm to 25 μm, and a vacuum metalization oriented polypropylene (VMOPP) layer having a thickness of from 9 μm to 50 μm; and said inner layer comprises a fusion-bonding layer having a thickness of from 1 μm to 10 μm, said fusion-bonding layer being formed on a prescribed portion.

10. The self-standing container as claimed in claim 1, wherein:

said laminate film further comprises an intermediate layer;

said outer layer comprises a polyethylene terephthalate (PET) layer having a thickness of from 9 μm to 25 μm;

said intermediate layer comprises an aluminum (Al) layer having a thickness of from 5 μm to 15 μm; and said inner layer comprises a material selected from the group consisting of a polyethylene (PE) layer and a non-oriented polypropylene (CPP) layer, which has a thickness of from 15 μm to 70 μm.

* * * * *